US006994508B2

(12) United States Patent
Mielonen et al.

(10) Patent No.: US 6,994,508 B2
(45) Date of Patent: Feb. 7, 2006

(54) METHOD AND ARRANGEMENT FOR HANDLING PARENT REELS

(75) Inventors: Eero Mielonen, Lahti (FI); Mauri Hillo, Hakiä (FI); Pekka Kunttu, Kuusankoski (FI)

(73) Assignee: Metso Paper, Inc., Helsinki (FI)

( * ) Notice: Subject to any disclaimer, the term of this patent is extended or adjusted under 35 U.S.C. 154(b) by 82 days.

(21) Appl. No.: 10/220,257

(22) PCT Filed: Mar. 5, 2001

(86) PCT No.: PCT/FI01/00217

§ 371 (c)(1),
(2), (4) Date: Sep. 30, 2002

(87) PCT Pub. No.: WO01/65007

PCT Pub. Date: Sep. 7, 2001

(65) Prior Publication Data

US 2003/0145969 A1 Aug. 7, 2003

(30) Foreign Application Priority Data

Mar. 3, 2000 (FI) ..... 20000501

(51) Int. Cl.
*B65G 67/02* (2006.01)

(52) U.S. Cl. ..... 414/470; 414/812

(58) Field of Classification Search ..... 414/282, 414/495, 470, 664, 346, 911, 350, 498, 473, 414/467, 460, 497, 474, 806, 812; 242/541.1, 242/541.5; 198/498

See application file for complete search history.

(56) References Cited

U.S. PATENT DOCUMENTS

| | | | | | |
|---|---|---|---|---|---|
| 4,131,206 | A * | 12/1978 | Kawada et al. | ..... | 414/352 |
| 4,164,187 | A * | 8/1979 | Kaufmann | ..... | 104/93 |
| 4,199,289 | A * | 4/1980 | Segbert et al. | ..... | 414/347 |
| 4,459,078 | A * | 7/1984 | Chiantella et al. | ..... | 414/279 |
| 4,934,413 | A * | 6/1990 | Yao | ..... | 139/1 R |
| 4,948,060 | A * | 8/1990 | Kurz et al. | ..... | 242/552 |
| 4,971,508 | A * | 11/1990 | Miyahara et al. | ..... | 414/282 |
| 5,009,096 | A | 4/1991 | Maenpaa et al. | ..... | 242/542.3 |
| 5,421,691 | A * | 6/1995 | Ferrone | ..... | 414/546 |
| 5,431,521 | A * | 7/1995 | Napierkowski et al. | ..... | 414/401 |
| 5,875,990 | A | 3/1999 | Svanqvist et al. | ..... | 242/542.3 |
| 6,615,973 | B2 * | 9/2003 | Fritter | ..... | 198/498 |

* cited by examiner

*Primary Examiner*—Eileen D. Lillis
*Assistant Examiner*—Charles A. Fox
(74) *Attorney, Agent, or Firm*—Cohen, Pontani, Lieberman & Pavane

(57) ABSTRACT

In this publication it is described a method and an arrangement for moving parent reels (1) between at least two handling stations with the aid of a parent reel cart (2, 3), wherein at least one of the stations a parent reel (1) is carried on carrier rails (15). At the first handling station, the parent reel is transferred to the parent reel cart (2, 3), the parent reel (1) is locked to the cart (2, 3), and the parent reel (1) is moved to the next handling station. The parent reel (1) is transferred to the next station and the parent reel (1) locking is released. According to the invention the parent reel is moved between the station and the cart by means of transfer carriages (8), which grip the ends of the parent reel and move independently over the junction between the carrier rails (15) of the station and the parent reel carts's means (13, 14) for carrying parent reels.

9 Claims, 5 Drawing Sheets

METHOD AND ARRANGEMENT FOR HANDLING PARENT REELS

PRIORITY CLAIM

This is a national stage of PCT application No. PCT/FI01/00217, filed on Mar. 5, 2001. Priority is claimed on that application and on the application No. 20000501 filed in Finland on Mar. 3, 2000.

BACKGROUND OF THE INVENTION

The present invention relates to a method and apparatus for handling after reeling, machine-width parent rolls reeled onto a reeling core, which come from a paper or board machine or are manufactured on a separate finishing line.

A parent reel refers to a machine-width reel manufactured on a paper machine or a board machine, which is wrapped around a reeling core, i.e. a parent reel iron. Parent reels are used to take manufactured paper or board to an intermediate store, prior to the paper being taken to a winder or the next processing stage. Usually, parent reels are used with off-line machinery, between the finishing equipment and the paper machine, and before the winder after finishing. As larger paper machines are nearly 10 m wide, parent reels are extremely heavy and require massive devices to move them. Parent reel diameters are about 3.5–4 m, so that wide parent reels weigh 120–160 t. The parent reels must sometimes be moved over long distances between the various production devices and store locations. Parent reel carts and quite often gantry cranes are used to move parent reels.

One problem associated with moving parent reels is taking them from the cart to the store and transferring them to the cart. This transfer generally takes place using rails tilted at 0.3–0.4°, along which the reels roll. The parent reels rest on such rails at the storage locations. Because the parent reels are very heavy and wide, this form of transfer causes many difficulties. The wide reels easily turn sideways as they roll. This can easily lead to their bearings dropping from the storage rails, which can damage the parent reel and the parent reel iron, while using a gantry, crane to lift the parent reel back onto the rails is both difficult and interrupts other reel handling. When parent reels are rolled along sloping rails from the parent reel cart to the storage irons or vice versa, a difference in height may occur between the ends of the rolling surfaces, allowing the heavy parent reel to drop onto the lower surface at these ends. This stepping wears the rails and the bearings of the parent reel and leads to their early replacement. When parent reels are moved by rolling, their movement onto and off the cart is difficult to control in other ways too. The speed of movement always depends on the slope used and cannot be altered. At the same time the parent reels can only be stopped at set stations, which have stops to arrest the movement.

To avoid the drawbacks referred to above, parent rolls can be moved using active transfer devices. In one such solution, double transfer cradles are arranged in connection with the storage irons. In this system, there is a double transfer cradle on the side of both storage rails, the transfer cradle having two transfer forks to be attached to the parent reels. Thus, a single transfer cart can be used to handle two parent reels. The transfer cradles are moved by means of a rack and pinion drive, the cradle drives being synchronized to prevent the parent reels from turning at an angle. The parent reel cart in turn has similar double transfer cradles, which are arranged to move in such a way that the parent reel is always received by the nearest transfer fork and correspondingly removed from the exit side using the nearest transfer fork. This makes the transfer cradle sufficiently long for it to be able to support the parent reel while it is moving from the side of the free end of the transfer cradle while the path of the cradle is made to extend from the parent reel cart to the reception point. In this solution, parent reels can be moved in a controlled manner, but at a storage station, for instance, the parent reel must be transferred from the transfer cradle of the parent reel cart to the cradles of the storage station, so that the transfer of the parent reel is considerably slower. If sloping rails are used to transfer the parent reel at the storage station, the system will have the weaknesses referred to above. Another significant drawback of this solution is that mechanically highly complicated and expensive devices are required both in the cart and at the storage location. In particular, the racks required by the transfer cradles and suitable rack and pinion drives for them increase costs, as does the synchronization of the parallel drives. Though the double-cradle solution of the parent reel cart permits an extremely strong construction, this same construction also becomes extremely heavy. As the transfer cradles are permanently attached to the cart, their paths are limited and the cart's cradles can only be used to transfer parent reels to and from the cart, but not, for example, to transfer the parent reels to a desired location at the storage station. The fact that separate transfer devices are required at both the receiving station and in the parent reel cart also contributes to the high cost of the solution.

SUMMARY OF THE INVENTION

The invention is intended to eliminate the defects of the state of the art disclosed above and for this purpose create an entirely new type of system for transferring parent reels, by means of which parent reels can be moved in a controlled and manageable manner.

The invention is based on fitting the parent reel cart with transfer carriages equipped with transfer forks for the ends of the parent reel iron, which carriages have means for moving the carriage along a track that does not form part of the parent reel cart, so that parent reels can be moved with the parent reel cart's transfer carriages at processing stations too and particularly along the rails of a storage station.

According to one preferred embodiment of the invention, the transfer carriages have a friction drive wheel, driven by a motor with frequency control. In this case, data on the location of the transfer carriage is obtained by measurement with a pulse sensor.

Considerable advantages are gained with the aid of the invention.

The most important advantage of the invention is that the devices incorporated in the parent reel cart can be used to control the parent reels during their transfer at a handling station too. The movement of the parent reels is then continuously controlled and they cannot move freely by rolling, so that it is also not necessary to stop the rolling movement. In principle, the operational area of the transfer carriages is in no way limited, permitting them to be used to carry out even long transfer and positioning tasks. As the transfer carriages are only in the parent reel carts, there is no need for separate transfer devices at the handling locations to control the movement of the parent reels, so that loading and unloading mechanisms are only required in one place. The transfer rails at the storage stations and other transfer locations can be horizontal, allowing the parent reels to move safely and avoiding the problems associated with freely rolling parent reels. Wear in the bearings and transfer rails due to the parent reels turning at an angle and to stepping are eliminated, giving the parent reel irons a longer operating life and possibly allowing the use of parent reel iron bearings with smaller dimensions and thus a more economical price. The invention can be used to control the parent reel traffic to such an extent that the entire traffic can be automated, if desired.

BRIEF DESCRIPTION OF THE DRAWINGS

In the following, the invention is examined with the aid of examples and with reference to the accompanying drawings.

DETAILED DESCRIPTION OF THE PRESENTLY PREFERRED EMBODIMENTS

Figure 1:
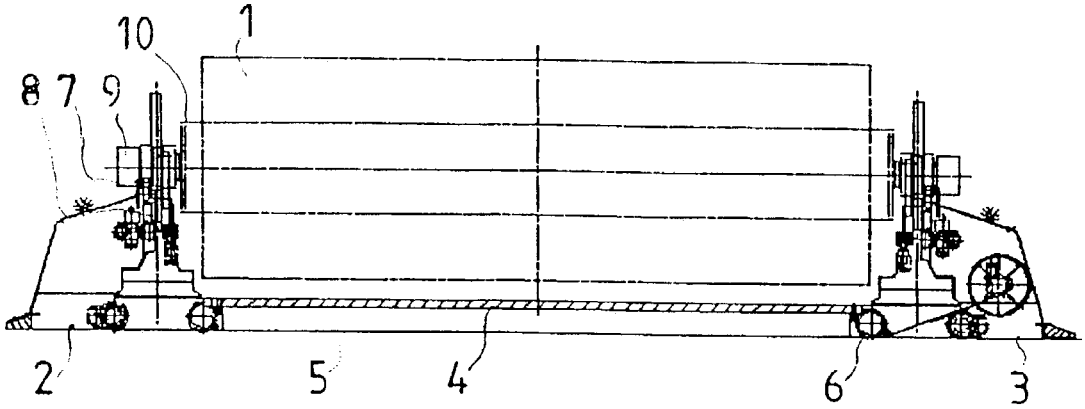
FIG. 1 shows a schematic side view of a parent reel transfer cart applying the invention.
Figure 2:
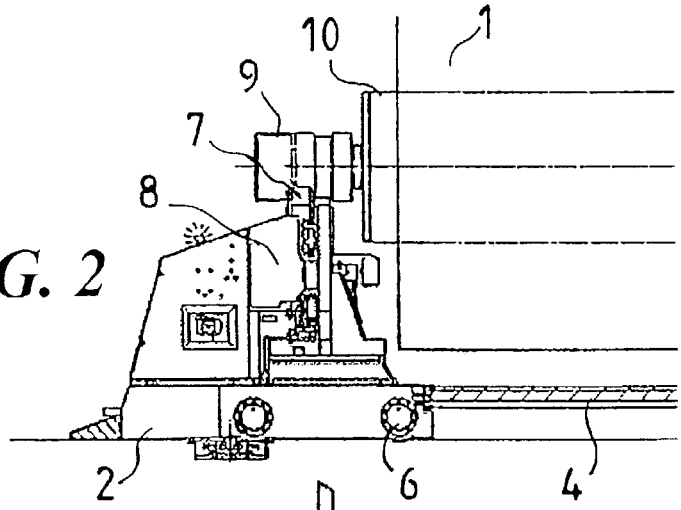
FIG. 2 shows a side view of one end of the cart of FIG. 1.
Figure 3:
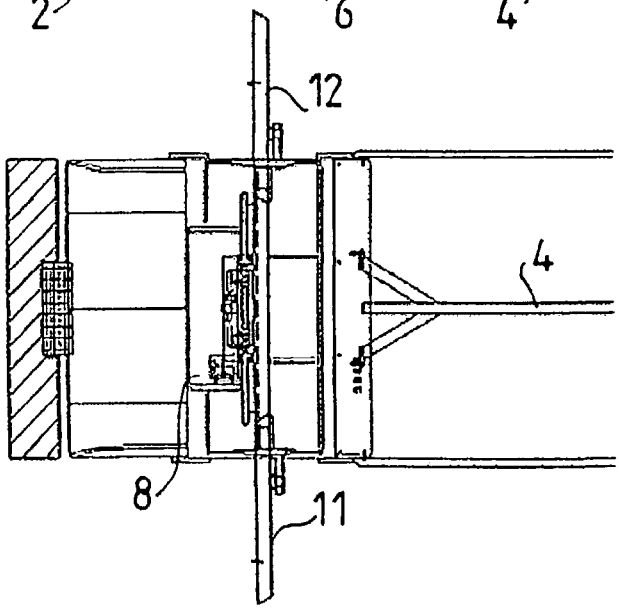
FIG. 3 shows a top view of the end of the cart of FIG. 2.

The parent reel cart according to the invention includes two cart ends, which carry the parent reel 1. One of the carts is a master cart 2 and the other is a slave cart 3 that follows the master cart. The master and slave carts are coupled together by means of a bar 4, master cart 2 controlling the movement of the parent reel cart and slave cart 3 following the control of the master cart. The parent reel cart is arranged to move on wheels 6 along rails 5, because rails give the system an adequate load-bearing capacity and allow both the path of the carts to be set reliably and the use of simple sensors when applying automatic control. Both the master and slave carts 2, 3 have transfer forks 7 and transfer carriages 8 to grip the ends of parent reel 1 and move parent reel 1. In addition, there are gates 11, 12 on both sides of carts 2, 3, along which the parent reels can be moved. As FIG. 2 shows, the transfer forks 7 grips the parent reels 1 at the bearings in their ends, the actual reeling core 10 remaining between the master and slave carts.

Figure 4:
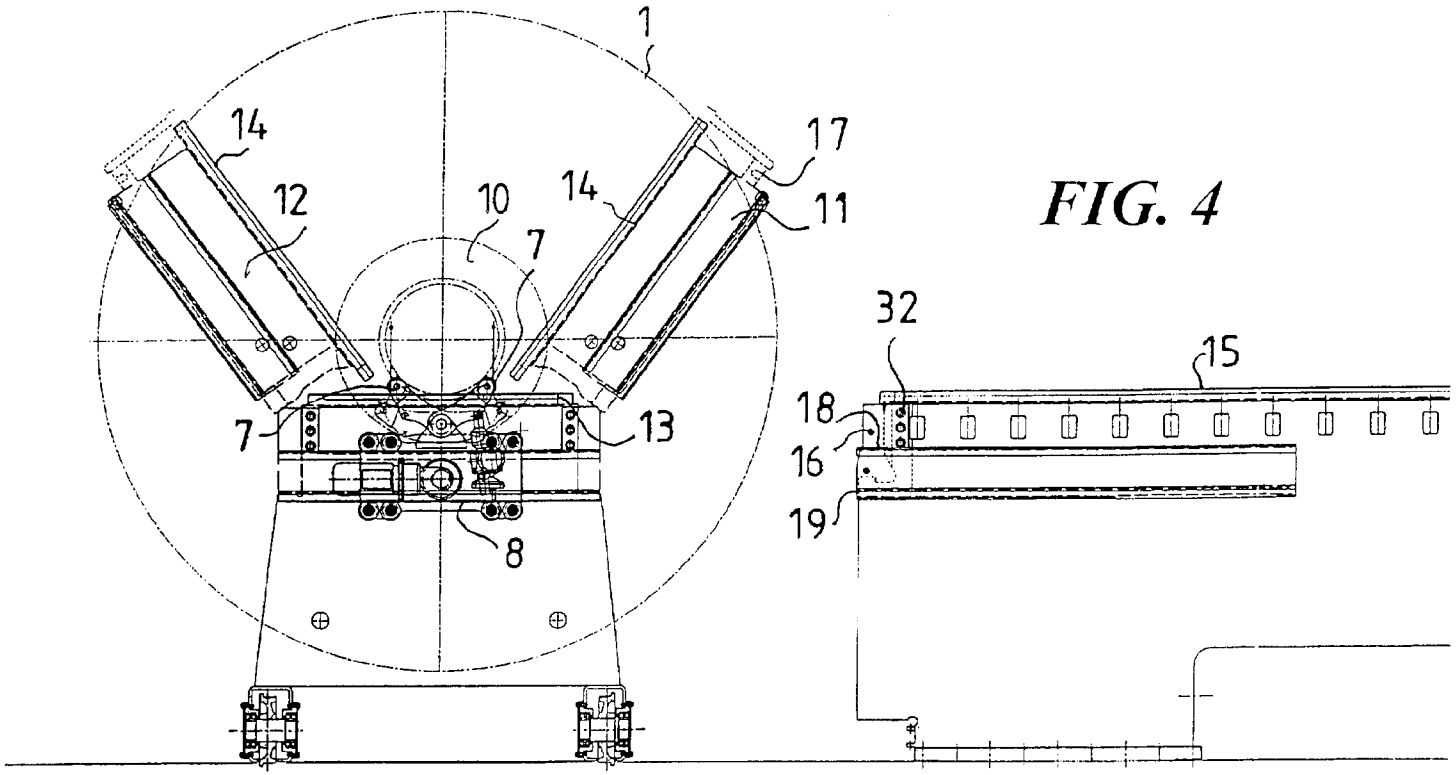
FIG. 4 shows a diagram of one embodiment of the invention during one transfer stage.
Figure 5:
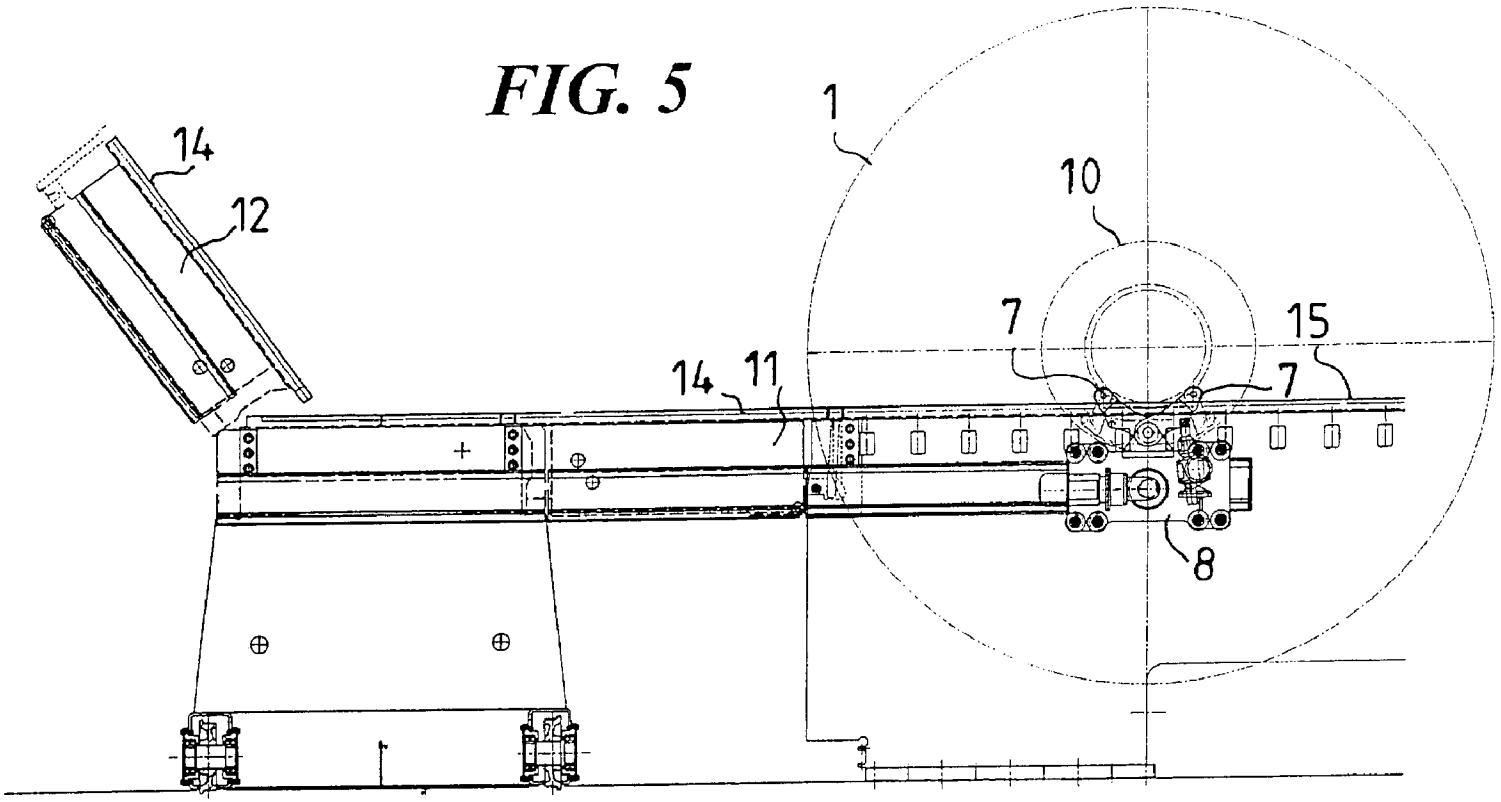
FIG. 5 shows a diagram of the embodiment of FIG. 1 during a second transfer stage.

FIGS. 4 and 5 show a parent reel being transferred from the parent reel cart to storage. In both positions, the parent reels 1 are shown with broken lines. In FIG. 4 the parent reel cart is in the transportation position. In that case, the gates 11, 12 are raised to form a V angle. Transfer carriage 8 is in the centre of the end of cart 2, 3, on the centreline of the parent reel cart and the transfer forks 7 are in the raised position. In this position, transfer forks 7 are secured to the parent reel end bearings 9 and lock the parent reel 1 to the parent reel cart. The raised gates 11, 12 provide additional security and prevent parent reel 1 from falling off the cart, even if transfer fork 7 or its locking fails. As transfer fork 7 can be turned to a protected position below the level of the parent reel cart's carrier rail 13, for example during loading with a crane, it is, however, unlikely to be damaged, which can in principle only occur if it is struck by some external object or a corresponding external impact. The length of the gates 11, 12 and the rails 14 in their upper surface is set in such a way that they extend to the end of the rail 15 of the handling station, when the cart is next to the handling station. In this case, the handling station is a storage station, which is formed with the aid of carrier rails 15. In the storage station, the parent reels lie on two parallel carrier rails 15. At the end of carrier rails 15 next to the path of the parent reel cart there is a guide slot 16, the ends of gates 11, 12 being shaped to correspond to the shape of slot 16. The end of gate 11, 12 and slot 16 are shaped in such a way that gate 11, 12 locks into the slot, in both the longitudinal and transverse direction of rails 14, 15. Locking can be carried out, for example, by means of a groove 17 in gates 11, 12 and a corresponding ridge. A locking wedge that fits into a hole in the floor is the main means used to ensure that the parent reel cart remains stopped and in the correct position at the handling station. Transfer carriage 8 is arranged to travel independently in both the parent reel cart and at the handling station along two rails 18, 19. The upper of these rails 18 can be termed the guide rail and supports the guide wheels 20, 21 of the transfer carriage laterally and vertically. The lower rail 19 can be termed the drive rail and supports the drive wheel 22 and its counter-wheels 23.

Figure 6:
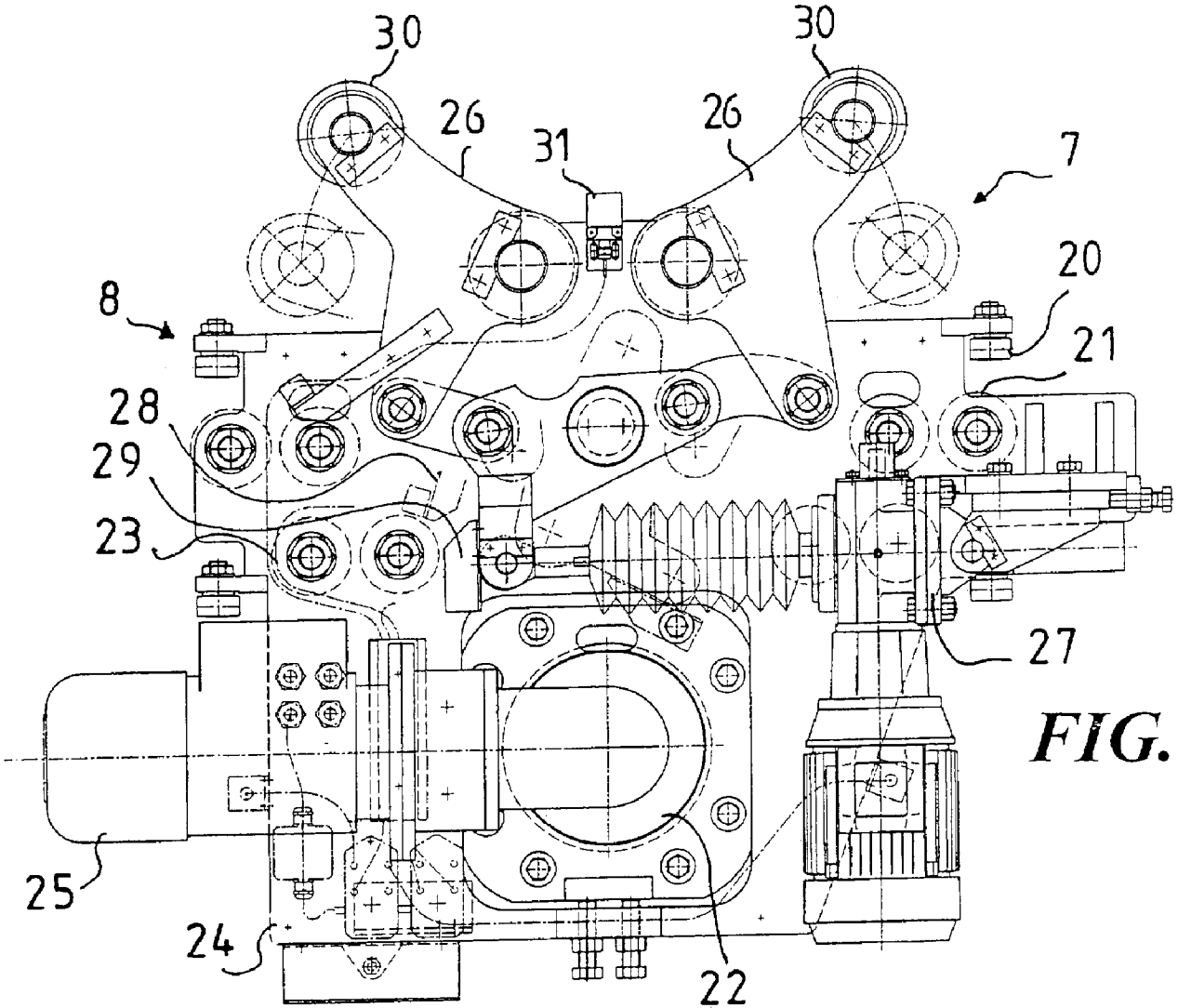
FIG. 6 shows a diagram of one part of the embodiment of FIGS. 1 and 2.
Figure 7:
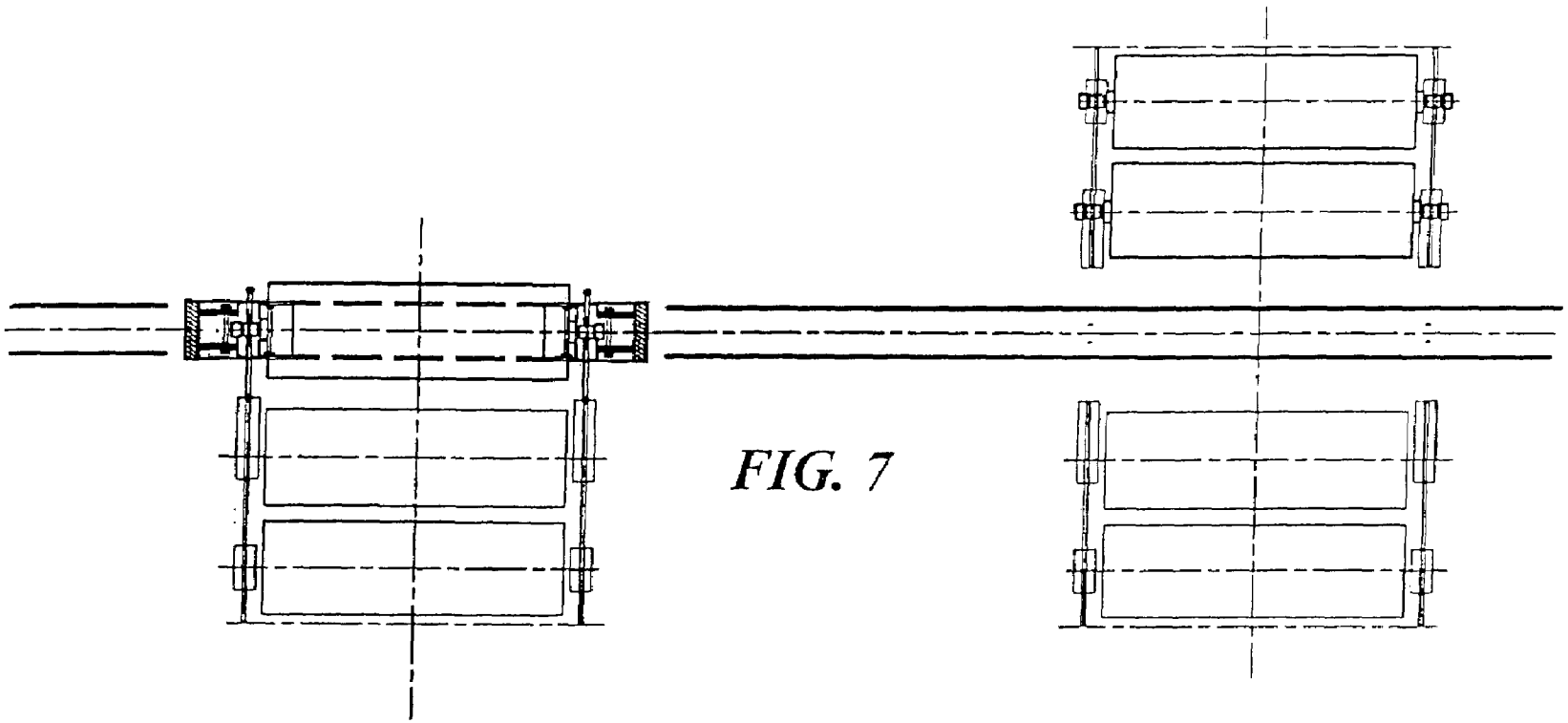
FIG. 7 shows a top view of one possible operating environment of the invention.

FIG. 6 shows one way of implementing transfer carriage 8 and transfer forks 7. Transfer carriage 8 is assembled on a frame 24. A planet-gear motor 25, with drive wheel 22 on its shaft, is attached to the underside of frame 24. A frequency converter, for example, can he used to control the motor, the distance of movement of which can be used to measure the position of the transfer carnage, for instance, using a pulse sensor. Other types of motor can also be used to drive the carriage. The only requirement for the motor is that its control must be possible with sufficient precision to achieve the necessary accuracy of positioning. Though hydraulic or compressed-air motors can be used instead of an electric motor, is easier to lead electrical current to the motor than compressed air or fluid pressure. The necessary friction force of drive wheel 22 is created by pressing the wheel against drive rail 18. To achieve the pressing force, counter-wheels 23 are fitted to the transfer carriage frame on the opposite side of the rail to drive wheel 22 when transfer carriage 8 is located on the parent reel cart or moving on the handling station's rails. Above counter-wheels 23 in frame 24 there are guide wheels 20, 21 to guide transfer carriage 8 accurately along guide rail 18 of the parent reel cart or the handling station. The guide wheels include horizontal guide wheels 21 set horizontally on an axle and lateral guide wheels 20 fitted to a vertical axle. By means of these wheels, the transfer carriage is made to travel along the desired path laterally and vertically.

Transfer carriage 8 grips the parent reels by means of transfer forks 7. Transfer fork 7 includes a pair of rocker levers 26 pivoted opposite to each other in the upper part of the frame and operated by means of lever arms. The operating device is a screw 27 driven by an electric motor, which produces the linear motion required by the lever arms. The positions of the lever arms are monitored with sensors 28, 29. The sensors show the extreme positions of transfer fork 7, and in this case any kind of electric motor can be used for the drive, because positioning or position data in the intermediate positions are not needed. At the ends of the rocker levers, there are rollers 30, which support the parent reel while permitting it to rotate. Between the pair of rocker levers 26, there is a sensor, which is used to monitor whether there is a parent reel between the rocker levers. One versed in the art can implement the operation of rocker levers 26 in many ways, so the construction of the linkage is not described in greater detail here.

The system according to the invention for handling parent reels operates as follows.

Parent reels can be loaded onto or unloaded from the cart either automatically using the transfer forks and carriages, or else with a crane. If a crane is used for loading or unloading, the operation does not differ from the normal handling of parent reels with a crane. When loading, however, it must ensured that rocker levers 26 of transfer forks 7 are turned to the lowered position, so that they are protected beneath the surface of carrier rail 13 of the parent reel cart. Once the parent reel has been lowered onto the cart, the transfer fork rocker levers are raised and the parent reel is secured and locked with the transfer forks. In automatic loading, the parent reels are picked up from the handling station using the transfer carriages. The home position of the transfer carriages in on the centreline of the parent reel cart in the middle of carrier rail 13 and movement starts from this position. When the parent reel cart has arrived next to the handling station, i.e. at the storage station in the example according to FIGS. 4 and 5, the gates 11 on the storage station side are lowered, so that they settle into the slots 16 of the storage station. The carrier rails 14 of gates 11 then connect the parent reel cart's carrier rails 13 and the storage station's carrier rails 15 to form a single carrier rail, along which the parent reels can be rolled. The carrier rail thus formed is preferably horizontal, so that the parent reel will not move by itself. It can be envisaged, however, that there might be, for example, a slight incline in the storage station rails, so that gravity can be used to roll the parent reel brought to the station into place. The transfer of the parent reel is, however, preferably carried out controllably with the aid of transfer carriages.

When the gates 11 on the handling station side are lowered, the transfer carriage rails in them form a unified transfer route with the rails 18, 19 of the handling station, along which the transfer carriages can run. When the parent reels are moved with the aid of transfer carriages 8, rocker levers 26 of transfer forks 7 are kept raised, so that they retain parent reel 1. There are approach switches in gates 11 and the handling station, and transfer carriage is only permitted to start moving once the lowering of gate 11 has been detected. Transfer carriage 8 moves between a home position in the centre of the parent reel cart and, in this case, the storage station. The carriage is moved by means of a frequency-converter-controlled geared motor while a pulse sensor detects the position of the transfer carriages. The measurement of the position of the carriages is used to ensure that both ends of the parent reel move simultaneously and to guide the transfer carriage to the desired location in the storage station. The extreme and home positions of the carriage are also detected using approach switches or other suitable sensors. Once the parent reel has been moved to the desired position, transfer forks 7 are lowered and the transfer carriages are returned to the parent reel cart and their home position. Next, the gates are raised and the parent reel cart can be moved to the station where the next parent reel is loaded onto it.

Loading takes place similarly to unloading, except that the order of the operations is reversed. In both loading and unloading, a check is first made that the parent reel cart is at a handling station and is connected to the station. Data transfer between the cart and the station takes place using a data-transmitting photoelectric cell, but any other method of data transfer can be used instead. Before the transfer carriage begins to move, sensor 31 is used to check that there is no parent reel in the transfer forks and the forks are lowered, to ensure that they can move freely under the bearings of the parent reel irons 10. This also prevents the moving forks possibly striking obstacles in their path and being damaged. The movement of the transfer carriages is controlled through the parent reel cart and they move independently on the rails of the storage station. Once the transfer carriages 8 are at a given pick-up point, sensor 31 is used to check that there is a parent reel at the forks and rocker levers 26 of transfer forks 7 are raised, in which case they grip parent reel 1. Transfer carriages 8 are now guided back to their home positions in the parent reel cart, the transfer forks forcing the parent reel to move with them. Once transfer carriages 8 are in the home position, the gates can be raised and the loaded parent reel cart can be moved to the following desired handling station.

The parent reel cart must be positioned at precisely the correct point at the handling station when the parent reels are transferred through the gates, so that gates 11, 12 can be lowered into the slots of the handling station. The arrival of a cart at the station is detected at the station limits. For this purpose, marks located on the floor or detectors read by the cart's sensors or reading devices are used. The station limits are intended to show the position of the cart at the station, while the floor also has station indicator pins, which are used to check which station the cart has arrived at. As such, the implementation of such a system of detectors and limits is known from the cart control of various piece-handling systems. Once a cart has stopped at a desired location, the parking wedge in the master cart drops into a hole in the floor and locks the cart in place and loading or unloading can commence.

Embodiments of the invention, differing from those disclosed above, can also be envisaged within the scope of the invention. The most important feature of the invention is the independently moving transfer carriages forming part of the parent reel cart, by means of which the parent reel can be independently moved over the junction between the parent reel cart and the handling station, i e. in the example above, over the joint in the rail between the gate and the handling station. Thus, when the transfer carriage is separated from the parent reel cart, it must be able to move mechanically along the guide means of the handling station. The power supply to, and control of the parent reel cart can perhaps be implemented with the least cost by means of cables attached to the parent reel cart, but it can be envisaged that the power supply and control can, for example, be arranged using current-supply rails or similar, when a data transfer system will be required between the transfer carriage and the control of the parent reel cart. On the other hand, to create the movement of the transfer carriages from the parent reel cart to the handling station, a transfer route, preferably a rail system along which the carriage moves, must be formed for the transfer carriages. Various kinds of guiding wheel/rail pairs are known, allowing this aspect of the invention to be implemented in many ways. The mechanical construction of the transfer carriage and the transfer forks can vary greatly. However, one important characteristic is that when the transfer forks are empty, they can be turned under the surface of the carrier rails of the parent reel cart or handling station during a transfer or crane loading, thus avoiding accidental damage to them. The control and construction of the parent reel cart itself can be easily adapted to the various existing systems at the mill, without deviating from the idea of the invention. The handling stations, between which the parent reels are moved, can be stores, winders and unwinders, cutters, or other devices used to process paper.

What is claimed is:

1. A method for moving parent reels between at least two handling stations with the aid of a parent reel cart, wherein on at least one of the stations a parent reel is carried on carrier rails, the method comprising:

at a first handling station, transferring the parent reel on the carrier rails from the first handling station to a means for carrying parent reels of the parent reel cart, the means for carrying parent reels comprising at least two transfer carriages each of which grips ends of the parent reel and each of which moves independently along the carrier rails of the first handling station, on a junction between the carrier rails of the first handling station and the parent reel cart, and moving said transfer carriages onto the parent reel cart;

after transferring the parent reel from the first handling station to the parent reel cart, locking the transferred parent reel to the parent reel cart;

moving the parent reel locked on the parent reel cart to a next handling station; and releasing the lock on the parent reel after moving the parent reel to the next handling station; and after releasing the lock, transferring the parent reel from the parent reel cart to the next handling station, wherein, when the parent reel cart arrives at a handling station, said junction is formed by at least two unified rails, each unified rail comprising a pivoting gate pivotably mounted to the parent reel cart and positioned to connect with a respective rail of the handling station at which the parent reel cart arrives to form a single rail, and wherein the gates are raised and disengaged from the handling station during moving of the parent reel cart between handling stations.

2. The method of claim 1, wherein a position of the transfer carriage is measured continuously during transferring of the parent reel; and wherein movement of the transfer carriage on the carrier rails and on the means for carrying parent reels is controlled on the basis of measured data of the position of the transfer carriage.

3. The method of claim 1, wherein at least two unified rails are carrier rails that carry the parent reel during transfer of the parent reel between the parent reel cart and the handling station and are positioned to connect with a respective carrier rail of the handling station at which the parent reel cart arrives.

4. The method of claim 1, wherein at least two unified rails are guiding rails that guide the transfer carriages during transfer of the parent reel between the parent reel cart and the handling station, and are positioned to connect with a respective guiding rail of the handling station at which the parent reel cart arrives.

5. An apparatus for transferring parent reels between a parent reel cart and a handling station, comprising:

carrier rails for carrying a parent reel, the carrier rails being located at the handling station;

a means for carrying a parent reel on the parent reel cart;

a means for locking a parent reel to the parent reel cart; and a pair of transfer carriages, each comprising means for gripping of the parent reel, the transfer carriages being adapted to move independently along the carrier rails of the first handling station, over a junction between the carrier rails of the handling station and the means for carrying parent reels on the parent reel cart, and on the parent reel cart.

6. The apparatus of claim 5, further comprising at least two pivoting carrier gates pivotably mounted to the parent reel cart, each earner gate being positioned to align with a respective carrier rail of the handling station to form a unified carrier rail to carry the parent reel during transfer of the parent reel between the parent reel cart and the handling station.

7. The apparatus of claim 6, further comprising at least two guide rails at the handling station, and further comprising at least two pivoting guiding gates pivotably mounted to the parent reel cart and positioned to align with a respective guiding rail of the handling station to form a unified guide rail to guide the transfer carriage during transfer of the parent reel between the parent reel cart and the handling station.

8. The apparatus of claim 6, wherein the means for gripping ends of the parent reel comprises transfer forks comprising rocker levers pivotably mounted to the transfer carriage so that one extreme position of each transfer fork is beneath the unified carrier rail.

9. The apparatus of claim 7, further comprising at least one friction drive wheel and at least one counter wheel operative for moving and guiding the transfer carriage along the unified guide rail.

* * * * *